US006523611B1

(12) United States Patent
Bakker et al.

(10) Patent No.: US 6,523,611 B1
(45) Date of Patent: Feb. 25, 2003

(54) APPARATUS FOR COMPLETING A SUBTERRANEAN WELL AND METHOD OF USING SAME

(75) Inventors: Thomas Walburgis Bakker, Vries; Bart Christian Van Belle, Amstelveen, both of (NL)

(73) Assignee: Well Engineering Partners B.V., Vries (NL)

( * ) Notice: Subject to any disclaimer, the term of this patent is extended or adjusted under 35 U.S.C. 154(b) by 0 days.

(21) Appl. No.: 09/622,958

(22) PCT Filed: Dec. 23, 1998

(86) PCT No.: PCT/NL98/00732

§ 371 (c)(1),
(2), (4) Date: Jan. 26, 2001

(87) PCT Pub. No.: WO00/39432

PCT Pub. Date: Jul. 6, 2000

(51) Int. Cl.[7] ..... E21B 29/08
(52) U.S. Cl. ..... 166/298; 166/51; 166/233
(58) Field of Search ..... 166/277, 278, 166/51, 185, 276, 233, 296, 91, 294, 115, 298

(56) References Cited

U.S. PATENT DOCUMENTS

| | | | | |
|---|---|---|---|---|
| 3,712,376 A | * | 1/1973 | Owen et al. | 166/277 |
| 4,932,474 A | * | 6/1990 | Schroeder, Jr. et al. | 166/278 |
| 5,062,484 A | * | 11/1991 | Schroeder, Jr. et al. | 166/278 |
| 5,165,476 A | | 11/1992 | Jones | |
| 5,240,074 A | | 8/1993 | Peavy et al. | |
| 5,355,956 A | | 10/1994 | Restarick | |
| 5,366,012 A | | 11/1994 | Lohbeck | |
| 5,415,227 A | | 5/1995 | Jennings, Jr. | |
| 5,494,106 A | * | 2/1996 | Gueguen et al. | 166/277 |
| 5,667,011 A | | 9/1997 | Gill et al. | |
| 5,785,122 A | | 7/1998 | Spray | |
| 6,073,692 A | * | 6/2000 | Wood et al. | 166/187 |

FOREIGN PATENT DOCUMENTS

| | | |
|---|---|---|
| WO | WO 93/06333 | 4/1993 |
| WO | WO 96/00821 | 1/1996 |

OTHER PUBLICATIONS

Tim Walker, Mark Hopmann, "Underbalanced Completions" SPE 30648, Oct. 22, 1995 pp. 185–191, XP002109222.

* cited by examiner

*Primary Examiner*—Frank Tsay
(74) *Attorney, Agent, or Firm*—Kinney & Lange, P.A.

(57) ABSTRACT

In completing a well bore in a underground formation, the well bore being closed off by a closing structure for blocking flow of pressurized fluid through the well bore, a substantially tubular element having a tube wall surrounding an axial bore is passed through the closing structure. The tube wall having passed the closing structure is processed along at least a portion of its axial dimension from a first condition into a second, processed condition. In the first condition, the tube wall is substantially impermeable in radial direction to pressurized fluid for precluding a flow of pressurized fluid from passing the penetrated closing structure. In the second condition the tube wall is radially permeable to pressurized fluid along at least a processed portion of its axial dimension. A tubular element to be used in such an application is described as well.

22 Claims, 7 Drawing Sheets

APPARATUS FOR COMPLETING A SUBTERRANEAN WELL AND METHOD OF USING SAME

BACKGROUND OF THE INVENTION

The invention relates to a method for completing a well bore in an underground formation, said well bore being closed off by a closing structure for blocking flow of pressurized fluid through said well bore, comprising the step of passing a substantially tubular element having a tube wall surrounding an axial bore through said closing structure.

Such a method is known from practice and is carried out in the course of the completion of a well, i.e. the finalizing operations for making a well bore ready for functions such as producing oil, gas or another fluid from the formation, reservoir observation or fluid injection.

However, in badly consolidated or fractured formations these functions can be hampered by inflow of particles into the well bore. Such particles can originate either from the formation itself or from proppant materials used to support the completion, i.e. the section of the well bore that is to perform the above-mentioned function. Such a particle inflow does not only further destabilise the formation, but can also block the well bore or may entail the need of separating the particles from fluid produced by the well bore.

To overcome this problem, it has been proposed to support the production section using a supporting device to support the formation and any proppant used for completing the well.

From U.S. Pat. No. 5,366,012, it is known to install a slotted tube as supporting device. The slotted tube is radially expanded to support the formation and/or proppant material. This is carried out when the slotted tube is located at an uncased bottom section of the borehole, and involves axially forcing a mandrel through the slotted tube to make it expand radially.

In practice, as part of the completion operation, after the well bore has been provided with a casing and a closing structure, such as a blow-out preventer, a production string carrying the slotted tube is passed through the closing structure.

However, since supporting devices such as slotted tubes are provided with penetrations, to be able to safely pass the supporting device through the closing structure, it is necessary to "kill" the well, by balancing the upward pressure of e.g. oil or gas in the formation with a fluid column in the well bore to avoid fluid flow from the well via the penetrations in the wall of the supporting device.

However, balancing a well is a time consuming operation which may also damage the formation and/or leave the well in an unsafe, uncontrollable condition.

SUMMARY OF THE INVENTION

It is an object of the invention to provide a solution which allows the completion of an uncased section of a borehole, without having to balance the well.

According to one aspect of the present invention, this object is achieved by carrying out a method of completing a borehole in accordance with claim 1.

This way, pressurised fluid in the well is substantially prevented from passing the penetrated closing structure, because the tube wall which is to complete the uncased section is impermeable to any pressurized fluid in the well as it penetrates and passes through the closing structure.

Portions of the tube wall having been brought in position or having at least passed the closing structure are made permeable, so that fluid can be received via the initially impermeable tube wall.

According to a further aspect of the invention, a pressurized drilling fluid is axially fed through said tubular element before said processing is carried out. This way, the drilling fluid can be used to power the drill and does not prematurely radially exit the tubular element through the circumferential openings.

According to another aspect of the present invention, the above-mentioned object is achieved by providing a tubular element in accordance with claim 10.

This tubular element can be passed through a closing structure for blocking a flow of pressurised fluid through a well bore, while a pressure drop over the closing structure exists without allowing fluid to the closing structure via the bore of the tubular element. In its production position, the tubular element can be made permeable to allow the fluid to be obtained from the well to pass into the production string via the tubular element.

Particular embodiments of the method and of the tubular element according to the invention are set forth in the dependent claims.

Further objects, features, advantages and details of the invention are described with reference to embodiments shown in the drawings.

DETAILED DESCRIPTION

Figure 1:
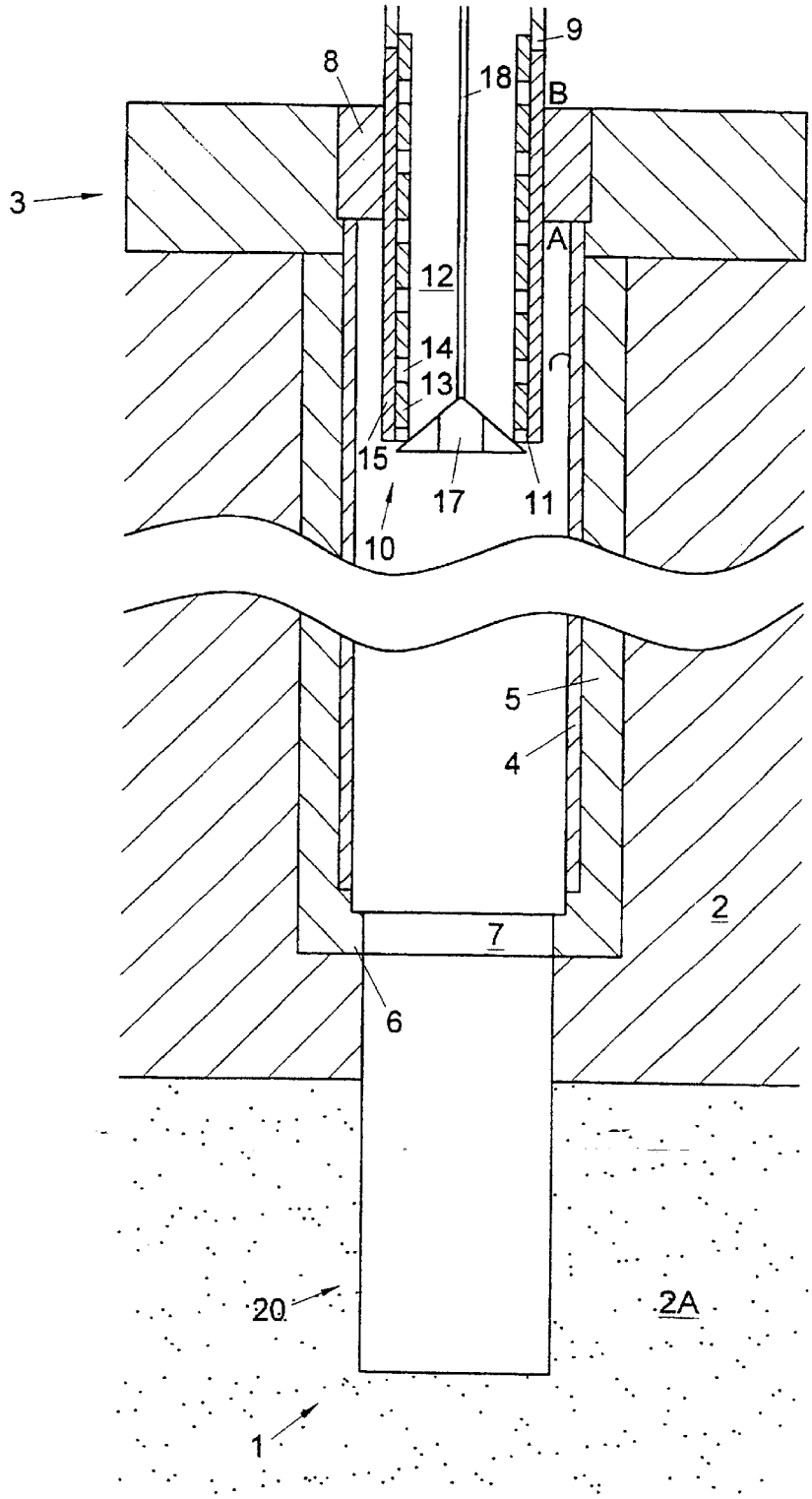
FIG. 1 shows schematically a cross-section of a well bore having a blow-out preventer as a closing structure being passed by a tubular element in first condition.

To enhance clarity, in the drawings, the radial dimensions have been drawn on an enlarged scale relative to the axial dimensions.

Figure 2:
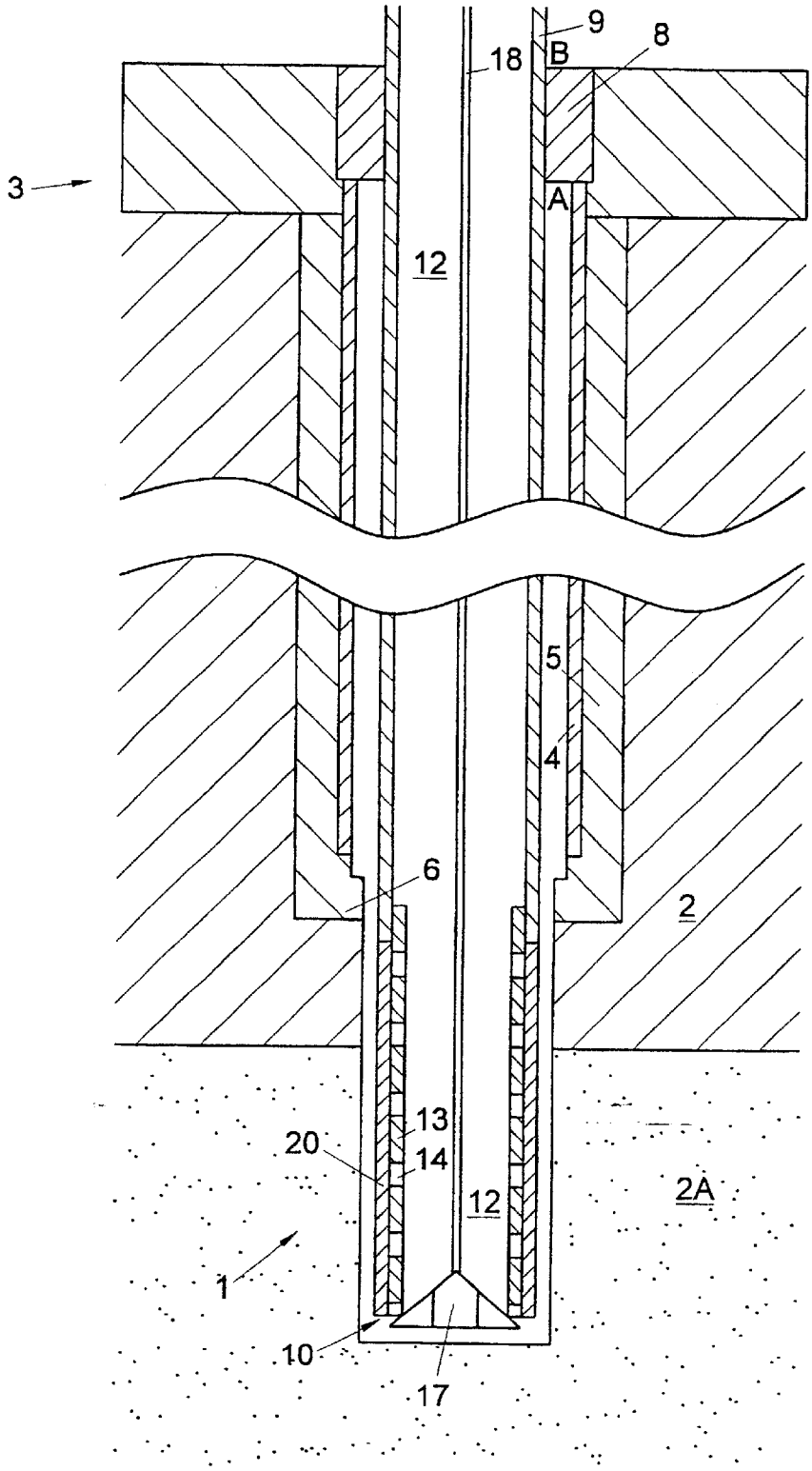
FIG. 2 shows the well bore of FIG. 1 with the tubular element in first condition being located in an uncased production zone.

FIGS. 1 and 2 show a well bore 1 in an underground formation 2. The underground formation 2 has a production zone 2A which may be badly consolidated, fractured or otherwise instable. The well bore 1 is closed off by a closing structure 3 preventing pressurized fluid from flowing up through the well bore 1. The well bore 1 has a casing 4 which is sealed to the formation by a layer of cement 5.

The well bore 1 comprises a cemented casing shoe 6 through which a hole 7 has been drilled into the production zone 2A, of the formation. The closing structure 3 is a conventional blow-out preventer system or a rotating preventer system. The closing structure 3 carries a packer 8 for sealing a tubing 9 passing therethrough. Such blow-out preventers are well known to those skilled in the art. In underbalanced condition, a relatively large pressure difference of 350 to 500 bar can be present between the faces A and B of the blow-out preventer.

As is shown in FIG. 1, a tubular element 10 having a tube wall section 11 surrounding an axial bore 12 is passed through an opening in the blow-out preventer 3. The tubular element 10 is in a first condition in which it is impermeable to pressurized fluid in radial direction and able to withstand a pressure of up to at least 50 bar and preferably at least the pressure rating of the preventer system.

The tubular element 10 has a tube wall section 11 which is weakened at circumferentially and axially distributed locations and composed of a tubular body 13 having a plurality of openings 14 and a cover layer 15 on the outer circumference of the tubular body 13, covering the openings 14. The tubular element 10 is sealed off at its bottom end by a mandrel 17.

When passing the blow-out preventer 3 while in a first condition, the tubular element 10 behaves essentially like a normal tubing section passing the blow-out preventer. Hence, when passing the blow-out preventer, the risk of a blow-out caused by underbalance is greatly reduced and unintended flow of pressurized fluid past the penetrated closing structure is prevented. Therefore, there is no need to precisely balance the well pressure. Accordingly, the risk of overbalancing the well and thereby damaging the well is substantially reduced and, in addition, time is saved.

When the tubular element 10 has passed through the closing structure 3 it is passed coaxially through the casing 4 while suspended from a transport tube 9 sealingly connected to the tubular element 10.

Figure 3:
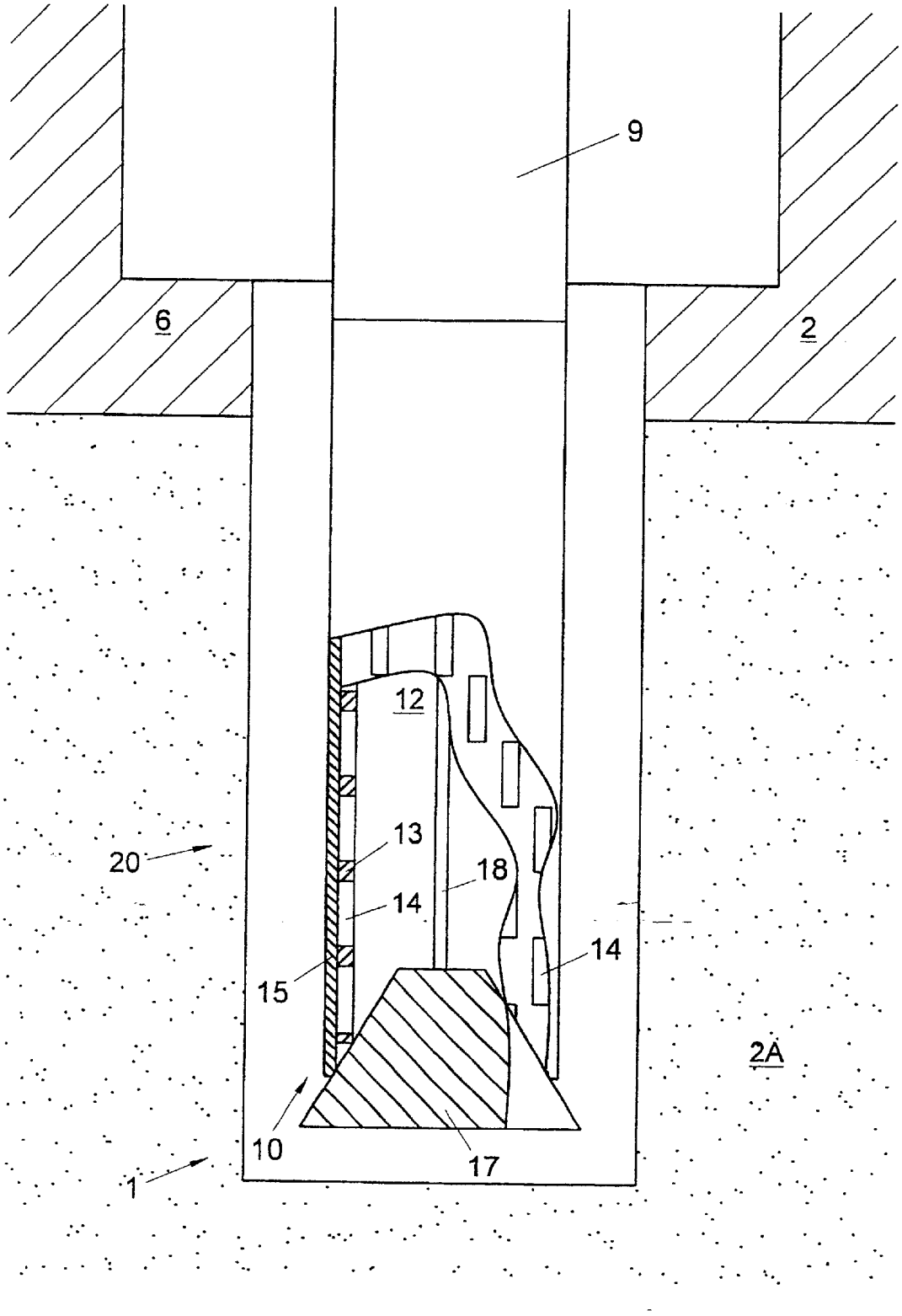
FIG. 3 shows schematically a partial cross-section of a tubular element in a first condition in an uncased production zone of a bore hole.
Figure 4:
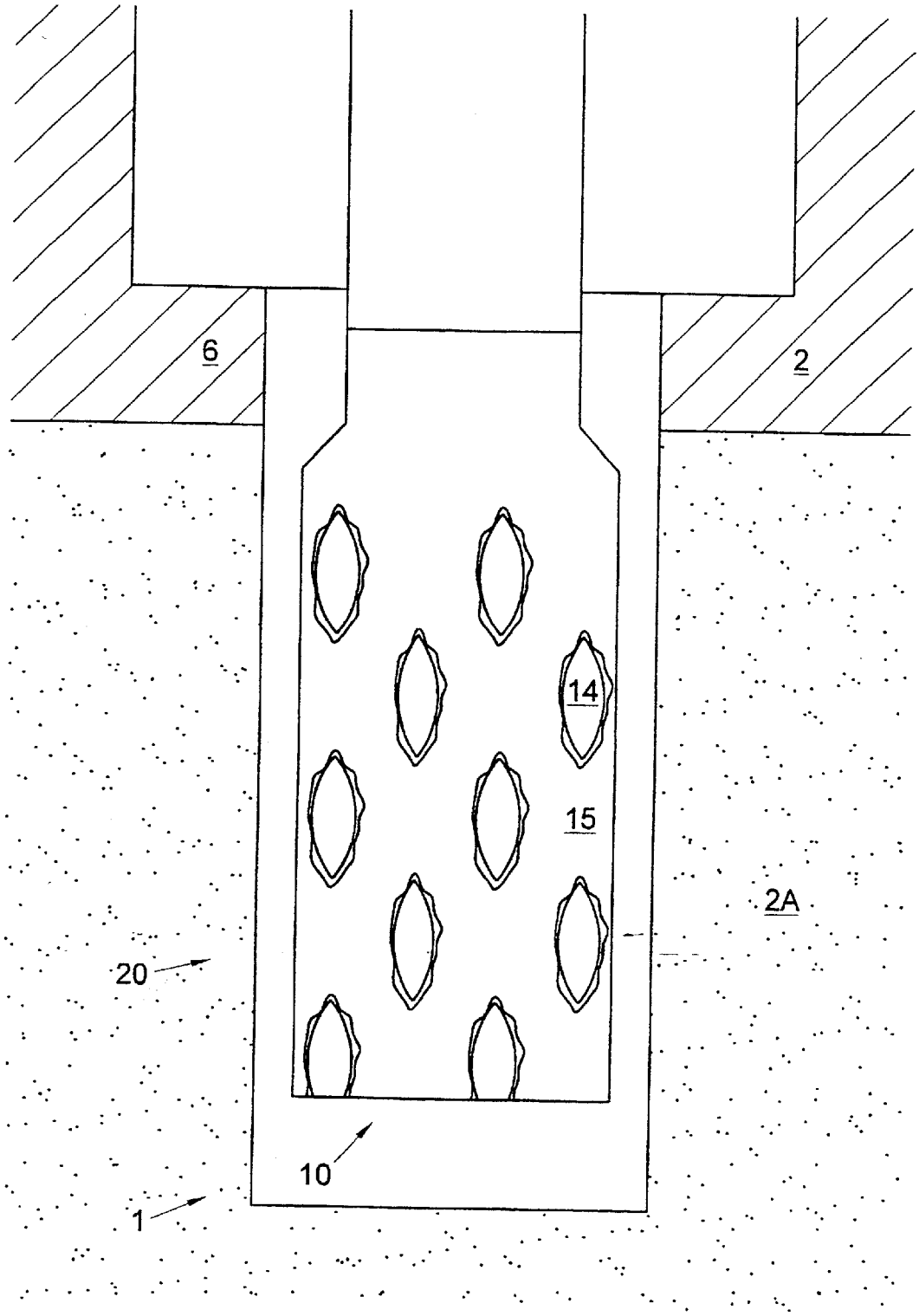
FIG. 4 shows schematically a cross-section of a tubular element in a second condition in a production section of a bore hole.

After the tubular element 10 has been positioned in an uncased production zone 20 of the well bore 1, the tube wall 11 is expanded along a major portion of its length, starting from a situation as shown in FIG. 3 to a situation as shown in FIG. 4. In the present example, this is carried out by axially retracting a mandrel 17 through the axial bore 12 of the tubular element 10. Thus, the tubular body is radially expanded as the mandrel 17 is passed through. By radially expanding the tubular element to its second condition, additional support of the oil producing formation 2A is provided by the expanded tube wall.

Figure 1A:
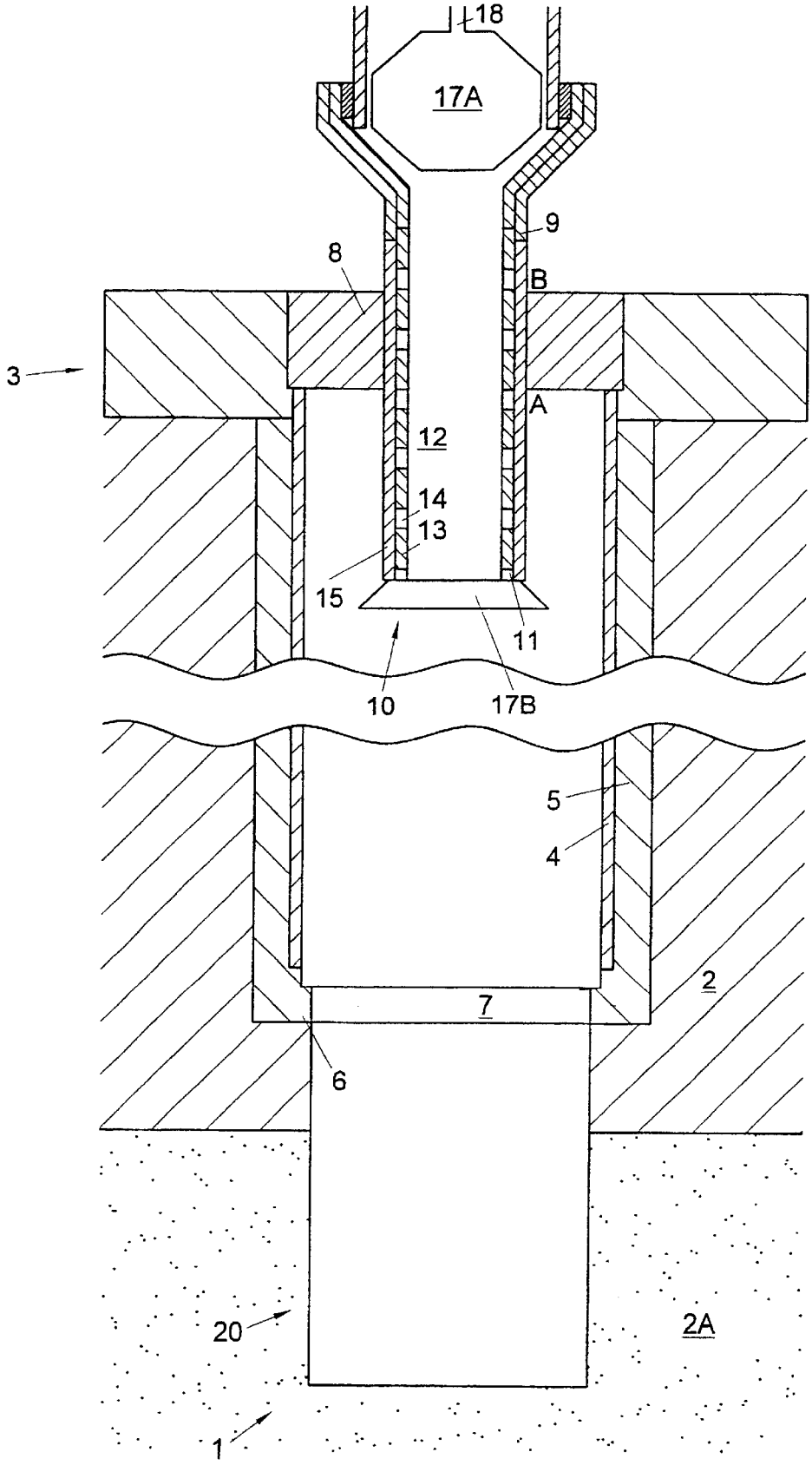
FIG. 1A shows an alternative embodiment of the tubular element of FIG. 1.

An alternative embodiment is shown in FIG. 1A. In this embodiment, radial expansion of the tube wall can be carried out by forcing an expander unit 17A downward through the tubular element 10. The bottom of the tubular element is closed off by a closing device, e.g. combined with a washing or drilling device 17B.

For suitable expansion methods, which are known as such, reference is made to U.S. Pat. No. 5,306,012. In particular, the mandrel 17 can be of a collapsible type, such that it can be inserted and retracted through the tubing 9 in collapsed condition. The mandrel 17 is suspended from a rod 18, which is also used to lower the mandrel and to pull the mandrel up.

Upon radial extension of the tubular body 13, the layer 15, which is substantially inextensible, is severed particularly at the locations of the holes 14 and becomes permeable in at least these locations. Due to the permeability, the pressure difference over the tube wall in the first condition is much lower than the pressure difference in the second condition. Oil and gas can now flow from the production zone 2A through the tubular element 10 into the tubing 9 and upwards through the tubing 9 under control of control valves above the well in the first condition. The pressure on the tube wall can e.g. be 350 to 1000 Bar higher than in the second condition.

Figure 5:
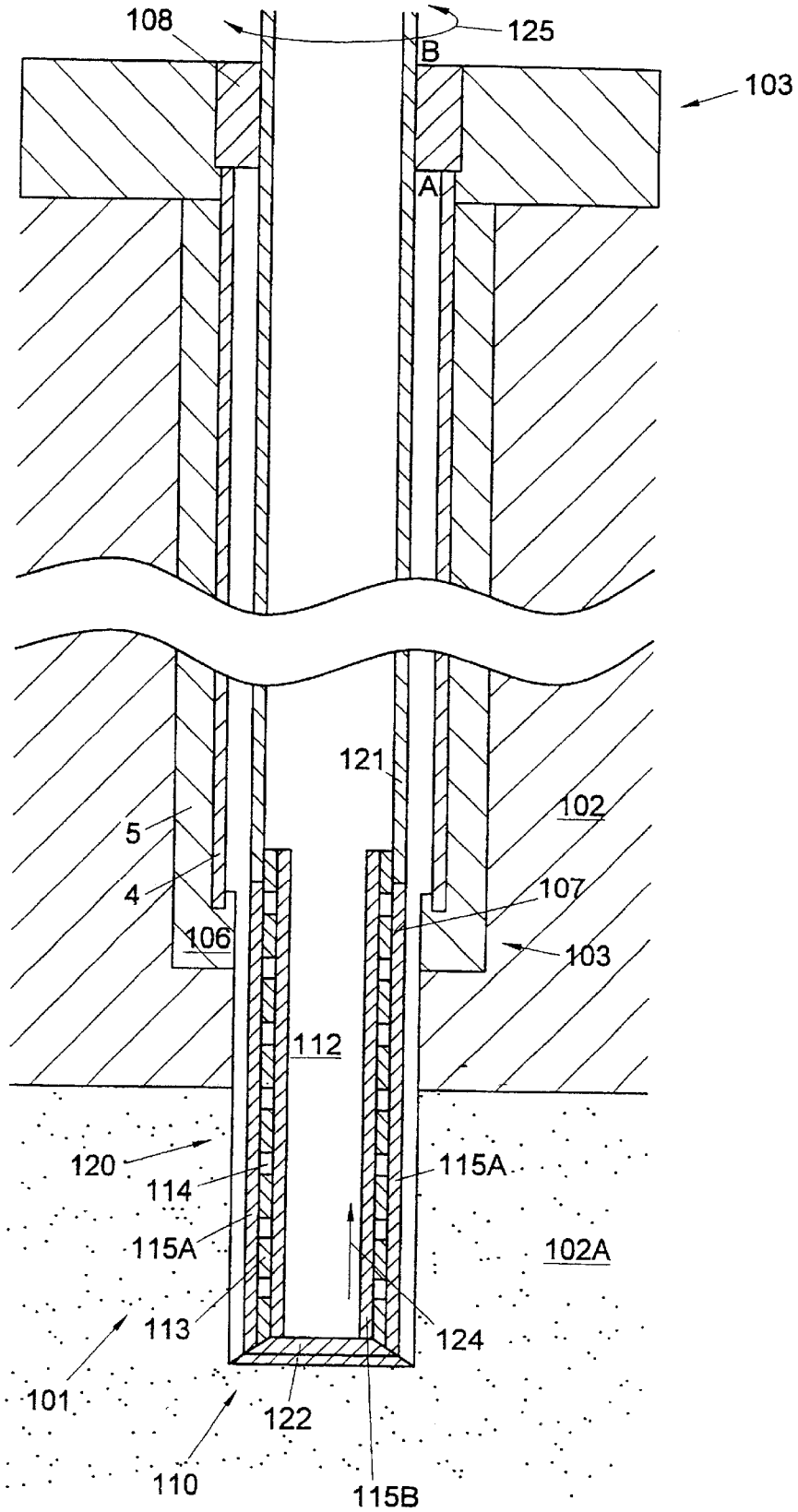
FIG. 5 shows schematically a cross-section of another well bore having a cemented casing shoe as a closing structure being penetrated by another tubular element in a first condition.

FIG. 5 illustrates another, presently most preferred method of completing a well bore 101. In this case, the well bore 101 has a closing structure 103 at the top and a cemented casing shoe 106 at the bottom of the well bore 101. As in the previous example, boring the well bore 1 and providing it with a cemented casing 4 can be performed using techniques well known to those skilled in the art.

When the production zone 120 is to be drilled, a hole 107 is drilled through the casing shoe 106 and then the production zone 120 itself is drilled in the production formation 102A beyond the casing shoe 106. During drilling, the drill string is rotated around its longitudinal axis, as indicated with arrow 125.

During drilling, pressurized drilling fluid is fed axially through the tubular element 110, e.g. through the axial bore 112 and exits the drill string through or near the drill bit 122. The tubular element is in the first condition and hence radially impermeable to the pressurized drilling fluid. This way, the drilling fluid does not exit the tubular element prematurely and can be used to power the drill and to wash away cuttings. The hole is drilled to total depth using the blow out preventer system on the surface to control the flow from the well.

After the tubular element 110 has been drilled sufficiently deep into the oil producing zone 102A and the tubular element 110 has reached the desired location in the production zone 120, the drill bit 122 is axially retracted through the bore 112 in the tubular element 110, i.e. in the direction of arrow 124.

This way, the tube wall 111 is radially expanded into its second condition. While being expanded, the tube wall 111 becomes radially permeable to pressurized fluid along the expanded portion of its length. Now, oil or gas can be produced from the production zone 102A. The expanding operation can be performed using an expander unit formed by or combined with the drill bit and a bottom hole assembly or with any other suitable expansion means Since in this mode of carrying out a method according to the invention, the drilling of at least a portion of the well bore is carried out using a drill string including the tubular element to be made permeable after reaching its production position, the time needed to prepare the production ready well bore is substantially reduced, because the operation of inserting the completion into the well bore is performed simultaneously with the operation of inserting the drill string into the well bore. Furthermore, because the tubular element can be expanded directly after the drilling operations, compared to having to retreive the tubular element and subsequently insert a supporting device, the chance of collapse of the borehole is greatly reduced and time is saved.

The tubular element 110 has a tube wall 111 provided with circumferentially and axially distributed openings 114. The openings are provided in a tubular body 113 which is covered by an outer layer 115A and an inner layer 115B of material. In its first condition, the tubular element 110 is impermeable to pressurized fluid and substantially inextensible. The layers 115A and 115B comprise a resinous material, such that upon radial expansion of the tube wall 111 of the tubular element 110, the layers 115A and 115B are severed and do not cover the openings 114 anymore, such that the tube wall 111 becomes radially permeable to pressurized fluid. Preferably, the layers 115A and 115B comprise a material that sticks to the tubular body 113 in the second condition to prevent soiling of the production zone 102A and of produced gas, oil or other produced fluids by foreign particles originating from the layers 115A and 115B.

The layers 115A and 115B each substantially enhance torsion stiffness of the tubular element 110, in particular if fibres in the layers 115A and/or 115B are laid-up in a torsion-resistant diagonally wound configuration. Thus, even though a large number of openings or otherwise weakened locations are provided in order to be opened upon expansion, it is nevertheless possible to use the tubular element 110 to transfer the substantial torque of typically up to 5000 to 25000 lbs required in a drilling operation.

The layers 115A and 115B comprise reinforcing fibres, preferably glass, carbon or other fibres embedded in a resinous matrix material. The fibres can be knitted, braided or wound to enhance the strength of the layer.

These constructional features contribute to providing a layer 115A or 115B that is sufficiently impermeable to pressurized fluid, sufficiently torsion resistant and that does not disintegrate upon expansion of the tubular element 110, so that the formation of loose particles is kept to a minimum.

Since the layers 15 in FIGS. 1–3 and 115A in FIG. 5 are located on the outside of the respective tubular bodies 13, 113, the tubular elements 10, 110 in the first condition have a particularly high resistance to external pressure. This is advantageous in situations in which the pressure on the outside of the tubular element 10, 110 is greater than the pressure on the inside of the tubular element 10, 110, e.g. when the well is underbalanced relative to the pressure in the production zone 2A, 102A.

The layer 115B in FIG. 5 on the inside of the tube body 113 provides a particularly high resistance against pressure from the inside of the tubular element 110, this occurs for instance when drilling fluid is supplied through the tubular element.

The layers 15, 115A and 115B can also serve to protect an additional structure interposed between the layer and the tubular body 13.

Figure 6:
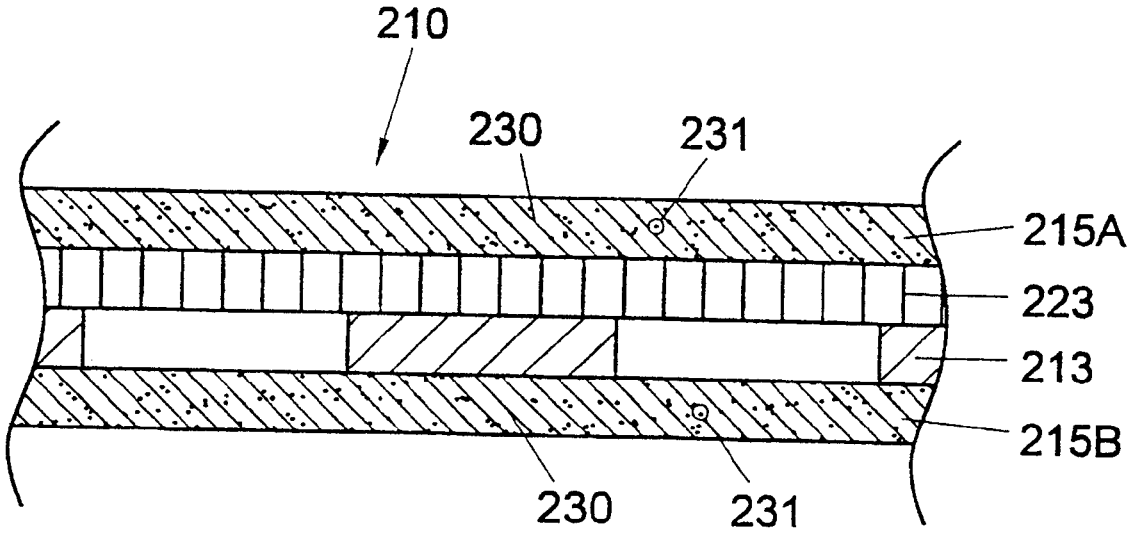
FIG. 6 shows a cross-sectional view of a wall portion of a still another tubular element.

FIG. 6 shows a build-up of layers in which an expandable screen 223 is interposed between an inner layer 215B of sealing material and an outer layer 215A of sealing material and to the outside of a tube body 213.

By providing that the screen is covered by a layer of sealing material, the expandable screen 223 is protected. The outer layer 215A for instance, protects the screen while the tubular element 210 is inserted into the casing. The inner layer 15A can serve to protect the screen 213 from being soiled or even clogged via the openings 14 by particles in the drilling fluid (mud). The reinforcing fibres in the matrix material 230 are shown as dots 232 and are indicated with reference numeral 231.

Although the invention has been described in detail with reference to a preferred embodiment, from the foregoing it will readily become apparent to those skilled in the art that many and varied changes can be made without departing from the spirit and scope of the invention.

For example, the tube wall can also be brought from the first condition into the second condition without radial expansion, e.g. by rotating or telescoping movement of two tubular bodies relative to each other, such that a number of holes are closed off in the first condition and are opened by alignment in the second condition. Furthermore, the tube wall section can be weakened in other ways, e.g. by recesses of which the material with decreased thickness is severed upon expansion, by barrel staves that overlap or that are adjacent in the first condition and that are interposed in the second condition. In addition, radial expansion using a mandrel can also be carried out by axially forcing the mandrel through the tubular element downwardly, i.e from top to bottom. Also, the production section can be located horizontally in the oil producing zone 2A. Such embodiments are readily available to the man skilled in the art and are within the scope of the following claims.

What is claimed is:

1. A method for completing a well bore in an underground formation, said well bore being closed off by a closing structure for blocking flow of pressurized fluid through said well bore, comprising the steps of:

a) passing a substantially tubular element having a tube wall surrounding an axial bore through said closing structure; and b) processing said tube wall along at least a portion of its axial dimension having passed said closing structure from a first condition into a second, expanded condition;

said tube wall in said first condition being substantially impermeable in radial direction to pressurized fluid for preventing pressurized fluid from passing said closing structure and said tube wall in said second expanded condition being radially permeable to pressurized fluid along at least the processed portion.

2. Method according to claim 1, wherein said processing of said tube wall involves expanding in at least a radial direction.

3. A method according to claim 1, wherein a first pressure difference is present over said tube wall in said first condition and a second pressure difference is present over said tube wall in said second condition, said first pressure difference being substantially larger than said second pressure difference.

4. A method according to claim 1, wherein said well bore comprises a casing and said tubular element is coaxially inserted within said casing using a transport tube carrying said tubular element.

5. A method according to claim 1, wherein said processing is carried out while said tube wall is located in an uncased production zone of said well bore.

6. A method according to claim 1, wherein, before said processing is carried out, a pressurized drilling fluid is axially fed through said tubular element.

7. A method according to claim 1, wherein, before said processing is carried out, drilling of at least a portion of said well bore is carried out using a drill string including said tubular element.

8. A method according to claim 1, wherein said closing structure is provided in the form of a cemented casing shoe at a bottom section of said well bore, further including the steps of drilling through said casing shoe and drilling into said underground formation beyond said closing structure to provide an uncased production zone of said well bore.

9. A method according to claim 1, wherein during or after said step of processing said tube wall along at least a portion of its axial dimension, a drilling element is axially retracted through said tube wall.

10. A tubular element for lining an uncased production zone of a well bore in an underground formation, said tubular element having a tube wall section surrounding an axial bore and being processable over at least a portion of its axial dimension from a first condition into a second, expanded condition, said tube wall in said first condition being impermeable to pressurized fluid and said tube wall in said second expanded condition being radially permeable in at least said processed portion to pressurized fluid.

11. A tubular element according to claim 10, wherein said processed portion in said second condition has an expanded cross sectional area surrounded by its external surface and a basic cross sectional area surrounded by its external surface in said first condition, said expanded cross sectional area being larger than said basic cross sectional area.

12. A tubular element according to claim 10, wherein said tube wall section in said first condition comprises a tubular body having a plurality of penetrations and at least one layer covering said penetrations, impermeable to pressurized fluid and substantially inextensible, and wherein, in said second condition, said layer is severed and permeable to pressurized fluid over at least a portion of the axial dimension of said tube wall section.

13. A tubular element according to claim 12, in which said layer comprises a resinous material.

14. A tubular element according to, claim 12, in which said layer comprises fibres.

15. A tubular element according to claim 14, in which said fibres form a knitted, braided or wound structure.

16. A tubular element according claim 12, in which said layer is a composite structure including fibres embedded in a matrix material.

17. A tubular element according claim 12, in which at least in said second condition said layer or said sealing material at least substantially adheres to said tubular body.

18. A tubular element according to claim 10, in which said tube wall in said first condition comprises a tubular body having a plurality of penetrations and sealing material sealing off said penetrations, said sealing material being located at least on the outside of said tubular body.

19. A tubular element according to claim 18, in which said tube wall in said first condition comprises a tubular body having a plurality of penetrations and sealing material sealing off said penetrations, said sealing material being located at least on the inside of said tubular body.

20. A tubular element according to claim 19, in which, in said first condition, an additional structure is interposed between an inner layer of sealing material and an outer layer of sealing material.

21. A tubular element according to claim 20, in which said additional structure is an expandable screen, protected by said layers of sealing material in said first condition.

22. A method for completing a well bore in an underground formation, the method comprising:

passing a substantially tubular element through a closing structure for blocking flow of pressurized fluid through the well bore, the tubular element comprising:

a tube wall surrounding an axial bore and having severed locations disposed along its length; and an impermeable covering layer blocking flow through the severed locations; and processing at least a portion of the tube wall to open the impermeable covering layer and to enlarge the severed locations into holes, such that the tubular element is converted to a second, permeable state.

* * * * *